US006206183B1

(12) United States Patent
Helsel

(10) Patent No.: US 6,206,183 B1
(45) Date of Patent: Mar. 27, 2001

(54) PAINTER'S BOX

(76) Inventor: Daniel C. Helsel, 2908 Carpenter Rd., Davidsville, PA (US) 15928

( * ) Notice: Subject to any disclaimer, the term of this patent is extended or adjusted under 35 U.S.C. 154(b) by 0 days.

(21) Appl. No.: 09/280,562

(22) Filed: Mar. 30, 1999

(51) Int. Cl.[7] ..... B05C 17/00

(52) U.S. Cl. ..... 206/1.7; 248/441.1; 248/460; 312/233

(58) Field of Search ..... 206/1.7–1.9, 504, 206/509, 511, 575, 561; 220/532, 533, 751, 23.4; 248/127, 128, 150, 154, 441.1, 460, 448, 449, 451–453; 312/233; 190/18 R

(56) References Cited

U.S. PATENT DOCUMENTS

| | | | | |
|---|---|---|---|---|
| 289,700 | | 12/1883 | Parker . | |
| D. 305,670 | | 1/1990 | Deusinger . | |
| 1,212,188 | | 1/1917 | Couper . | |
| 3,465,893 | | 9/1969 | Kinney . | |
| 4,123,127 | * | 10/1978 | Ford | 312/233 |
| 4,335,812 | * | 6/1982 | Koves | 206/1.8 |
| 4,372,630 | * | 2/1983 | Fuhri | 206/1.7 |
| 4,886,239 | * | 12/1989 | Stimmel | 206/504 |
| 4,889,254 | * | 12/1989 | Vola | 220/23.4 |
| 5,257,721 | * | 11/1993 | Smith et al. | 206/1.8 |
| 5,655,651 | | 8/1997 | Maier . | |
| 5,860,518 | * | 1/1999 | Axelrod | 206/1.7 |
| 5,899,429 | * | 5/1999 | McCloud | 248/441.1 |
| 5,950,979 | * | 9/1999 | Mira | 248/460 |

* cited by examiner

*Primary Examiner*—Luan K. Bui
(74) *Attorney, Agent, or Firm*—Banner & Witcoff, Ltd.

(57) ABSTRACT

A painter's box including provisions for painter's supplies and being supportable on an easel, the box including both a base and lid, the base including opposed top and bottom portions interconnected by opposed side portions, the bottom portion being provided with a groove for interconnection with an easel, the lid including a female connection area for interlocking with a male connector mounted on the easel.

14 Claims, 3 Drawing Sheets

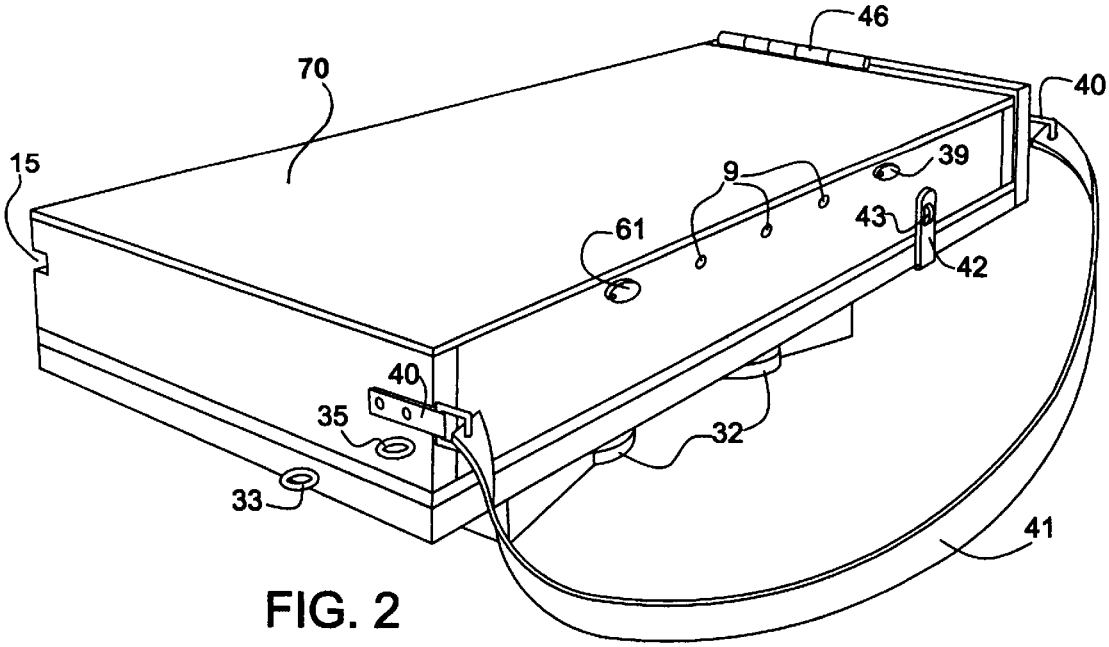
FIG. 2
FIG. 5
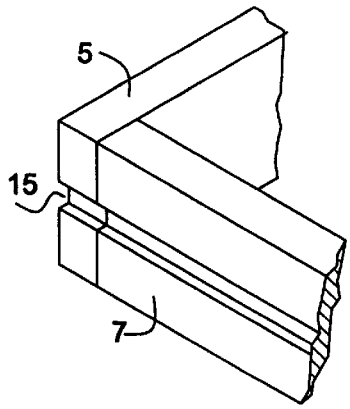
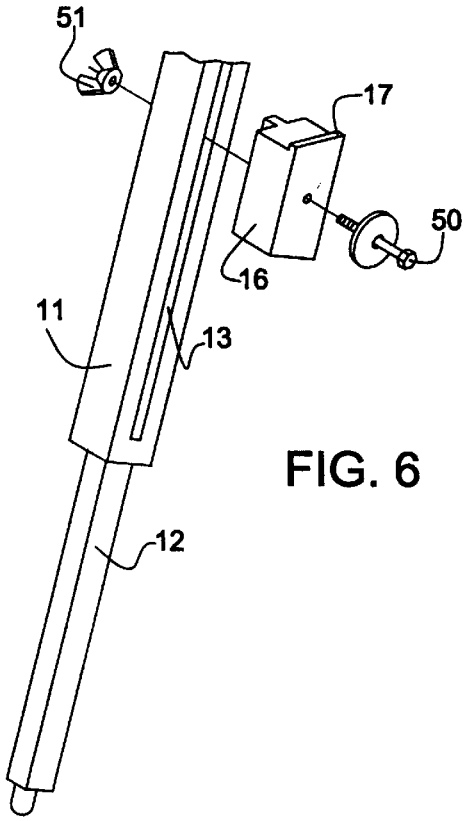
FIG. 6
FIG. 7
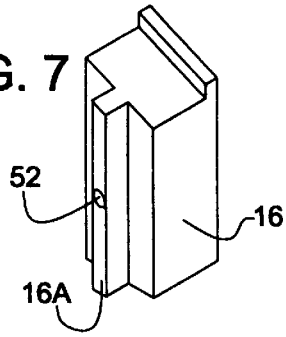

PAINTER'S BOX

FIELD OF THE INVENTION

The present invention, in general, relates to painter's boxes and more particularly to such boxes which are easily transported, accessorized for all of the artist's needs, and which may be supported directly on conventional easels.

BACKGROUND OF THE INVENTION

Over the years, there have been many proposals to provide a structure which combine the canvas support of an easel with a painter's box which supports the painter's paints, brushes and other supplies. Such devices have generally combined, in one structure, both the box and canvas support, such as those shown in U.S. Pat. No. 4,372,630. Others have combined the box with an easel through use of substantial modification of both the box and easel with the box including separate support legs and being substantially permanently attached to the easel. This type of device is shown in U.S. Pat. No. 1,212,188. A number of other proposals have been made to removable connect palettes to easels as shown in U.S. Pat. No. 3,465,893 or D305,670, but without provision for artist's supplies or only for brushes as in U.S. Pat. No. 289,700. Finally, palettes have been combined with easels as shown in U.S. Pat. No. 5,655,651 or previously cited U.S. Pat. No. 1,212,188.

However, none of the prior art has provided a simple box-easel combination which does not require additional ground support, is easily mounted and demounted from a conventional easel and which contains provisions for all necessary artist's supplies.

SUMMARY OF THE INVENTION

It is a principal object of the present invention to provide a painter's box which is easily connected to standard artist's easels.

It is a further object of the invention to provide a simple interconnect between the painter's box and the easel which requires only minimal modification to the conventional easel.

Another object is to provide a mountable painter's box which includes provisions for both painter's supplies as well as a palette.

Still another object of the present invention is to provide an easel mountable painter's box which in its closed position easily stores internally all of the painter's premixed paints, the box being easily transported

BRIEF DESCRIPTION OF THE DRAWINGS

FIG. 2 is a perspective view of the painter's box shown in FIG. 1 in the closed position without the lid-base support chain.

FIG. 5 is a view of the bottom of the painter's box including a mounting groove which insets into the canvas mounting block on the easel.

FIG. 6 is partial sectional view of a support leg of an easel showing the painter's box support block mounted thereon.

FIG. 7 shows, in detail, the rear of the support block of FIG. 6.

DETAILED DESCRIPTION OF THE PREFERRED EMBODIMENT

Figure 3:
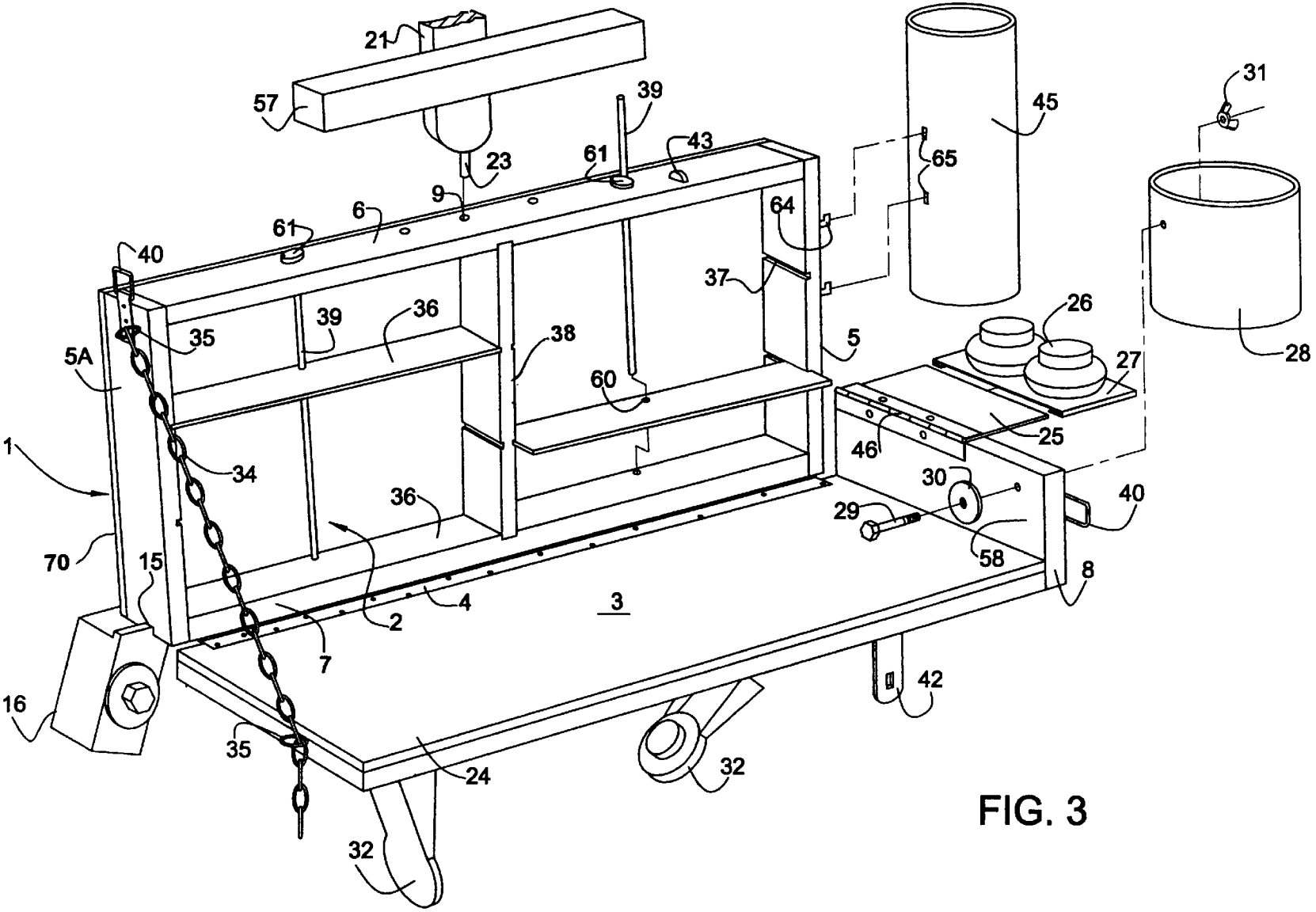
FIG. 3 is an exploded view showing details of the interconnection of the box to the easel and the attachment for painter's supplies in and on the box.

Referring primarily to FIG. 3, the painter's box, generally designated 1, consists of a lid portion generally designated 3 and a rectangular base portion generally designated 2, interconnected by a piano type hinge 4. The base 2 includes right side wall 5, left side wall 5A, a top portion 6 and an opposed bottom portion 7. A back portion 70 shown in FIG. 2 overlays the side walls and top and bottom portions. The lid 3 is of generally rectangular flat configuration of substantially the same size as the rectangular base and includes an upstanding painter's accessory support 8 extending from one side of said lid. The interconnection hinge 4 is positioned between the outer edge of the bottom portion 7 and the lid 3 as shown in FIGS. 1–3.

To connect the box to an easel, a hole 9 is provided in the top portion 6 of the box and a groove 15 is provided in the bottom portion 7 of the box, each of these features mating corresponding structure on an easel as now described.

Figure 1:
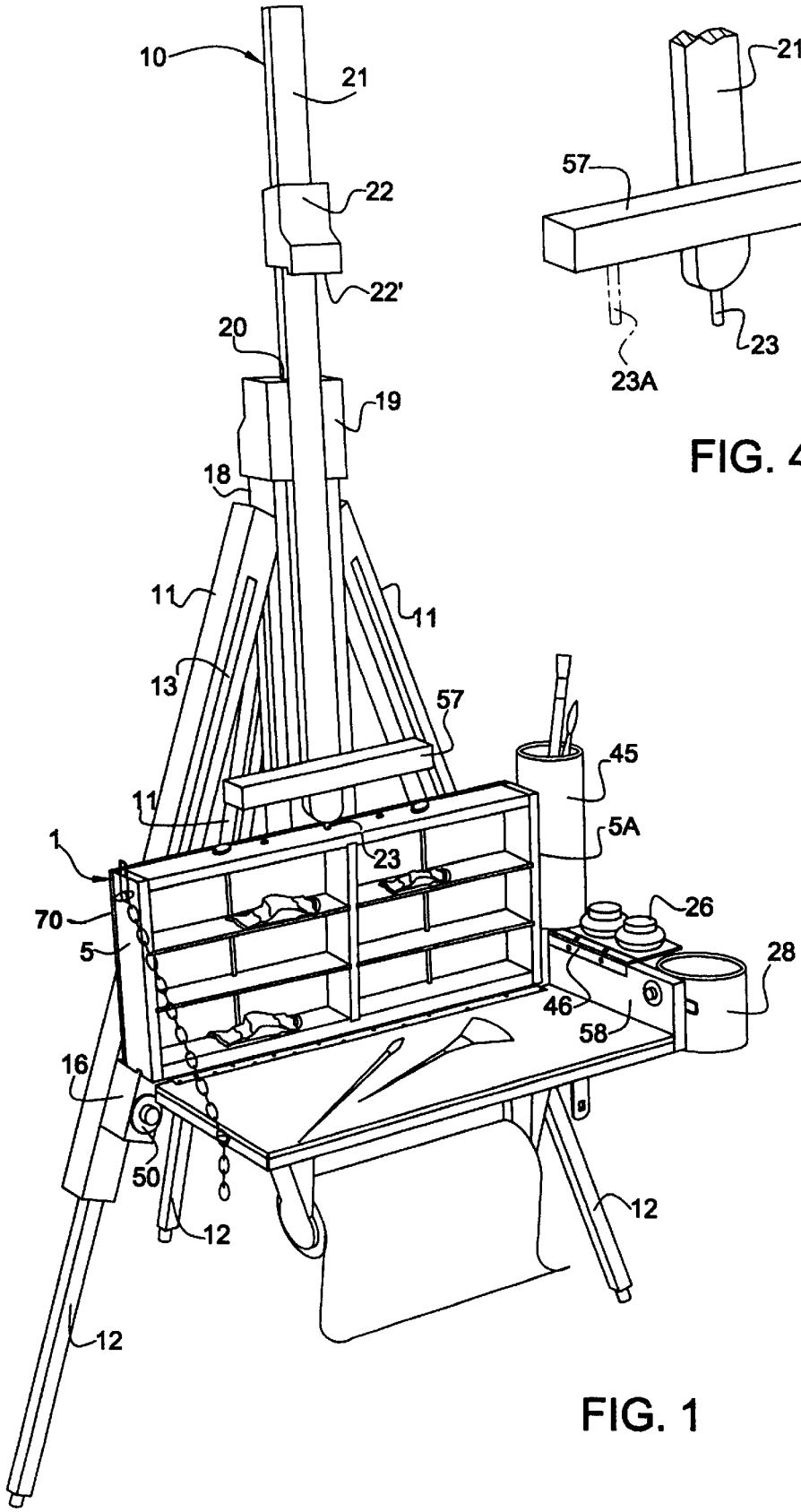
FIG. 1 is a front left side perspective view showing the painter's box mounted on an easel.

The easel generally designated 10 in FIG. 1 comprises a number of standard features including a tripod structure including three legs 11 with telescoping extension 12 slidable therein. The extensions 12 are held in position by bolts with washers and wing nuts (not shown) which pass through slots 13 in the legs 11 and holes in an upper portion of the extensions.

Mounted on the tripod legs are blocks 16 with upstanding lips 17 which are matable with groove 15 (FIG. 5) in box base portion 2. As shown in FIG. 6, these support blocks are also mounted on the legs 11 with a retainer bolt 50 with wing nut 51 passing through the block slot 13. When the easel is not in use, the blocks are mounted at the upper end of slot 13 in order that the leg extensions 12 may be retracted into legs 11. As shown in FIG. 7, the block 16 includes a central protrusion 16A which fits, into the slot 13 to minimize lateral movement of the block. The hole through which the bolt 50 passes is shown in block 16 at 52.

The easel legs are supported on a central post 18 which terminates at its upper end in a block 19 which has a slide groove 20 that supports an adjustable canvas retainer support 21 that is slidable in the slide groove 20 and locked in position by a locking pressure wing nut (not shown) on the back of block 19. The canvas retainer support 21 includes an upper block 22 which includes a depending lip 22' that grips the upper edge of a canvas and a lower support 57 upon which the lower edge of the canvas may rest. This structure is conventional in many easels and forms no part of the instant invention. The retainer support 21 is modified by providing at least one pin 23 depending from the lower end thereof as shown in FIG. 1 and in detail in FIG. 4. The pin 23 is circular and is held in a counter bore in the retainer support 21. The pin is so sized as to be insertable into hole 9 in the top portion 6 of box base portion 2.

In the preferred embodiment, as detailed in FIG. 5, the groove 15 in the bottom portion of the box extends into a groove in the box side. Alternatively, the base piece may traverse the entire length of the box with the end of the sides bolted, nailed or screwed thereto, thereby eliminating the need for a groove in the side portions 5 and 5A.

As shown in FIG. 3, the box contains or supports all requisite surfaces and containers that painters deem necessary for studio or field painting.

The lid portion includes a smooth upper surface 24 which functions as a palette. The lid side extension 8 includes a hinge 46 supporting a palette cup retainer shelf 25 to which may be attached palette cups 26 which are integral with a clip type holder 27 slidable over the palette cup retainer shelf 25. In addition, a brush cleaning cup 28 may be attached to the side extension by bolt 29, washer 30 and wing nut 31. Although the nut is shown to be positioned inside the cup, the bolt may be positioned such that the wing nut is on the inside of extension 8.

Depending from the lower surface of lid 3 is a towel holder including paper towel roll supports 32. The paper towel holder would be attached by screws (not shown) and would include roll support arms which are pivotable into an upright position. The particular details of such paper towel holders are well known.

The side edge of lid 3 includes an screw eyelet 33 which supports a link at one end of a chain 34. The other end of chain 34 may be connected to an eyelet 35 provided in the side 5A of the box base. These eyelets are most clearly shown in FIG. 2. The length of chain 34 between eyelets 33 and 35 may be varied to allow the painter's box to be adjustable supported in the open position with the palette surface level and can be removed when the box is closed during transit.

The upper portion of the box is provided with shelves 36 which are insertable in grooves 37 on the inside of upper side walls 5 and 5A and a central wall 38 which extends centrally between top portion 6 and bottom portion 7 as shown in FIG. 3. The shelves are held in place by rods 39 which pass through (the top portion 6) holes 60 in the shelves and rest in depressions in the bottom portion 7. They are retained by retainer clips 61 on the outside of the top portion. The shelves may be removed or repositioned by rotating the retainers, whereby the rods are exposed and thereafter removed. After shelf replacement, the rods are reinserted and the retainers rotated back to overlie the rod ends. These shelves are used to support oil or acrylic based paints extruded in ribbons from paint tubes that can be used directly or pre-mixed to any desired shade.

The upper edge of the side 5 and accessory support 8 include strap holders 40 to which may be removable attached carrying strap 41.

A latch 42 is provided on the lower surface of lid 3 which interconnects with keeper 43 on base 2 to latch the case closed during travel.

Figure 4:
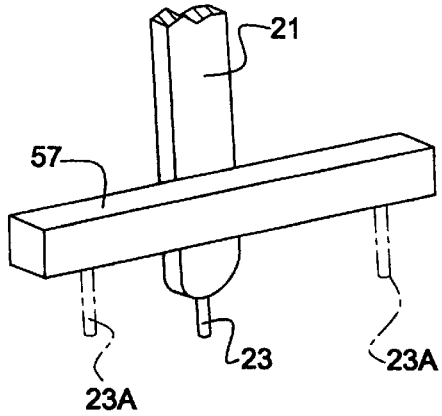
FIG. 4 shows the detail of the center post of the easel with an attachment pin which mates with a hole in the painter's box.

As shown in FIG. 4, after the palette cups 26 on the retainer clip 27 is removed and the box closed, the retainer shelf 25 may be pivoted on its hinge 46 to overlay the outer surface of the back of the box. Alternatively, before the box is closed, the shelf 25 may be pivoted 270° to lay flat against the inner wall 58 of the accessory support 8. In the latter configuration, a gap of the depth of the shelf 25 is provided between the extension 8 and the right side wall 5.

As shown most clearly in FIG. 3, to support a brush holder 45, two L shaped brackets 64 are attached to the outer surface of right side wall 5 to mate with holes 65 in holder 45.

When the painter's box is not being used all of the paints remain stored inside the box.

In using the box, the easel is first set up with its leg extensions positioned at the length desired whereafter the support blocks 16 are slid to a lower position on the slot 13, as shown in FIG. 1, and the bolts 50 tightened. The groove 15 in the bottom portion 7 of the box base portion 2 is then placed in the upstanding lip 17 (FIG. 6) of the support blocks 16. Thereafter, the canvas retainer support 21 is moved downwardly until the pin 23 enters the hole 9 in the top portion of the box and the retainer support 21 abuts the surface of the box.

Once the painter's box is attached and the chain 34 attached to eyelets 33 and 35, the latch 42 removed from keeper 43, the box opened and all of the accessories added as shown in FIGS. 1 and 3. When it is desired to transport the box and easel, the above procedure is reversed.

Although the above describes the use of an upper pin and lower lip combination to support the box on the easel, it is possible that alternative holding and support means could be used. For example, an eyelet could be inserted in the position and in place of the hole 9 which could be secured to the easel by a hook suspended from the retainer support.

In addition, although the pin 23 is shown inserted into and maintained in retainer support 21, it is contemplated that pin 23 may be removable or inserted into box top portion 6 prior to insertion into a mating hole in retainer support 21.

Alternatively, two pins or hooks could be suspended from the lower canvas support as shown in phantom in FIG. 4 to mate with two of the holes 9 or eyelets positioned on the top portion 6 of box base portion 2. This latter feature would be utilized in easels where the canvas retainer support 21 and the central post 18 are integral with both the support block 22 and the lower support 57 being adjustable in a central groove in support 21. With this arrangement, sufficient length of the support 21 is provided below lower support 57 whereby a single block 16 may be adjustable mounted in the central groove of support 21 with the painter's box being mounted between the lower canvas support and the block. Specific easels which could include this feature are manufactured by Testrite Instruments Co., of Newark, N.J. and sold under the name "STANRITE" studio easel.

Similarly, the bottom mounting brackets although preferably utilizing lips, may instead use pins matable with the grooves or holes in the box. Additionally, as in the case of the upper pin support, it is further contemplated that the bottom of the box may include a raised lip as shown at 17 on block 16 in FIG. 6 which would mate with a groove such as 15 formed in the block 16.

Of course, different managements of the accessory supports are contemplated and additional supports could be added, if desired. However, the specific configuration as shown in the drawings has been found most desirable for right handed artists. If desired, for left handed artists, all of the supports could be moved to the left side of the box.

It will be apparent to those skilled in the art that various modifications and variations can be made in the articles and methods of the present invention without departing from the spirit or scope of the invention. Thus, it is intended that the present invention cover the modifications and variations of this invention provided they come within the scope of the appended claims and their equivalents.

What is claimed is:

1. A painter's box and easel combination, said painter's box comprising a base and a hinged lid connected thereto, said base including side walls, opposed top and bottom walls and a back wall at least one indentation on said bottom wall of said base and at least one orifice on said top wall of said base; said lid being hinged to an outer edge of said bottom wall said easel comprising a canvas support, at least one protuberance supporting attachment positionable on a lower portion of said easel and at least one depending connector mounted on an upper portion of said easel said protuberance on said lower portion of said easel being matable with said indentation on said bottom wall of said box base and said connector interconnectable with said orifice on said upper wall of said box base; and wherein said protuberance on said easel comprises two blocks, one block being attached to each of the legs of said easel, each block including a lip and the indentation on the Painter's box comprises a groove extending across the bottom wall of said base.

2. The painter's box and easel combination of claim 1, wherein the easel includes a slidable canvas retainer support to which a depending connection pin is appended and the orifice on the upper wall of the base is a hole therein in which the pin may be inserted.

3. The painter's box and easel combination of claim 1, wherein the box includes removable shelves mounted in the base and the lid includes a smooth upper surface suitable for use as a palette.

4. The painter's box and easel combination of claim 3, wherein the lid includes a side extension to support a palette cup retainer shelf and connectors to support a brush cleaning cup.

5. The painter's box and easel combination of claim 4, which further includes a towel holder retractable suspended from a lower surface of said lid.

6. The painter's box and easel combination of claim 1, which further includes supports for a chain to hold the box open when the box is positioned on the easel and a carrying strap for use when the box is closed.

7. The painter's box and easel combination of claim 1, wherein the lid includes a smooth upper surface suitable for use as a palette.

8. The painter's box and easel combination of claim 1, wherein a piano type hinge interconnects the base to the lid.

9. A painter's box for attachment to an easel, said box comprising a base and a hinged lid connected thereto, said base including side walls, opposed top and bottom walls and a back wall, said lid being attached to said base by a hinge between said lid and an exposed edge of said bottom wall, said bottom wall including at least one indentation or protrusion suitable for interconnection to supporting structure on a leg of an easel and an orifice or connector on said top wall suitable for attachment to mating structure on an easel, wherein the indentation or protrusion on the bottom wall of the base is a substantially continuous groove across said bottom wall between said side walls, said box further including:

removable shelves mounted in the base and the lid includes a smooth upper surface suitable for use as a palette;

a side extension to support a hinged palette cup retainer shelf; and a towel holder retractable suspended from a lower surface of said lid.

10. The painter's box of claim 9, wherein at least two orifices are provided on the top wall of the base.

11. The painter's box of claim 9, which further includes supports for a chain to hold the box open when the box is positioned on the easel and a carrying strap for use when the box is closed.

12. The painter's box of claim 9, wherein one orifice is provided in the top wall of the base to mate with a pin on an easel.

13. The painter's box of claim 9, wherein the lid includes a smooth upper surface suitable for use as a palette.

14. The painter's box of claim 9, wherein a piano type hinge interconnects the bottom wall of the base to the lid.

* * * * *